US006480827B1

(12) United States Patent
McDonald

(10) Patent No.: US 6,480,827 B1
(45) Date of Patent: Nov. 12, 2002

(54) METHOD AND APPARATUS FOR VOICE COMMUNICATION

(75) Inventor: Oliver F. McDonald, Pembroke Pines, FL (US)

(73) Assignee: Motorola, Inc., Schaumberg, IL (US)

( * ) Notice: Subject to any disclaimer, the term of this patent is extended or adjusted under 35 U.S.C. 154(b) by 0 days.

(21) Appl. No.: 09/517,101

(22) Filed: Mar. 7, 2000

(51) Int. Cl.[7] ..... G10L 21/04
(52) U.S. Cl. ..... 704/500; 704/254; 704/242
(58) Field of Search ..... 704/249, 200, 704/231, 232, 235, 242, 246, 257, 256, 500, 503, 248; 341/110; 381/22, 23

(56) References Cited

U.S. PATENT DOCUMENTS 3,969,698 A * 7/1976 Bollinger et al. ..... 704/200
5,515,475 A * 5/1996 Gupta et al. ..... 704/242
5,689,532 A * 11/1997 Fitzpatrick ..... 375/341
5,907,822 A * 5/1999 Prieto, Jr. ..... 704/202
5,917,837 A * 6/1999 Stein ..... 714/758
5,943,347 A * 8/1999 Shepard ..... 381/94.5
5,946,651 A * 8/1999 Jarvinen et al. ..... 704/223
6,092,045 A * 7/2000 Stubley et al. ..... 704/254
6,138,093 A * 10/2000 Ekudden et al. ..... 704/228
6,226,613 B1 * 5/2001 Turin ..... 704/256

* cited by examiner

*Primary Examiner*—Tālivaldis Ivars Šmits
*Assistant Examiner*—Daniel Abebe
(74) *Attorney, Agent, or Firm*—Scott M. Garrett

(57) ABSTRACT

A telecommunication system and method having a transmitter and receiver for voice encoded signals. The receiver has a speech post-processor connected as an element before conversion of the speech from digital form and delivery of the speech to a listener. The speech post-processor processes select sequences of speech signals of a predetermined duration, and obtains the most likely estimation of a speech sequence that contains unrecognized phonemes. The speech post-processor has a recognizer and parser that receives speech signals, parses them into corresponding phonemes or unrecognized phonemes. Speech sequences of preselected duration are selected, and processed through an execution trellis implemented by a Viterbi algorithm to obtain a most likely sequence estimation for sequences which contain unrecognized phonemes, and determined phonemes replace the unrecognized phonemes. Only speech sequences with unrecognized phonemes are directed to the execution trellis. Following processing, the speech sequences are re-combined in time order.

6 Claims, 3 Drawing Sheets

22

METHOD AND APPARATUS FOR VOICE COMMUNICATION

TECHNICAL FIELD

The invention relates to a method and apparatus for voice communication system that obtains greater speech correlation performance between input and output utilizing a speech post-processor.

BACKGROUND

In voice telecommunications and speech storage systems, losses of speech information segments occur as a result of channel impairments, perturbations or imperfections. Sometimes these losses occur due to storage media. For wireless or packet based voice communications, these impairments or perturbations are primarily due to additive noise, interference, fading or network congestion. For digital communications in particular, source coding is used which consists of speech compression algorithms whose performance heavily relies on accurate reception of the compressed information in order that high quality reproductions can be achieved at the receiver. To this end, channel coding consisting of forward error correcting codes (FEC) coupled with interleaving methods is applied. In addition to FEC, an error mitigation method consisting of replaying previous good frames in place of bad frames or attenuation is applied. In spite of the advances of this technology, the channel disturbances frequently result in audible speech that is only partially intelligible. Customarily, the listener must perform a mental piecing together of the voice components heard, in order to make sense out of a sentence or phrase. If the listener cannot do so, the meaning is usually lost. The distortions of speech most frequently observed are missing speech segments or noisy, unintelligible sounds.

SUMMARY OF THE INVENTION

This invention is a method and apparatus for voice communication in which the receiver of the system includes a novel language-dependent speech post-processor which seeks to correct for many of the speech distortions caused by channel errors.

What this invention seeks to do is to perform a post processing of speech information that was digitally transmitted and might have been corrupted due to channel impairments. The system, in the short term, is very often unable to recover the lost or corrupted information due to the standard processing method of error control coding. Also these channel error induced disturbances are very often not well mitigated by known error mitigation techniques that are applied to the decompressed speech on the receiver side.

Recovery of speech information in the previously mentioned situations is achieved by the present invention by the unique utilization of a novel speech post-processor treatment of the speech which otherwise would have been delivered by the receiver to the speaker. The speech post-processor treatment uses a novel interpolation between signal segments corresponding to the phonemes of a selected sequence which contain unrecognized phonemes, and employs a technique that determines the most likely sequence implemented by the Viterbi algorithm for preselected speech sequences. The method and apparatus operates via the speech post-processor to develop the most likely sequence estimation for the selected sequence in which phonemes were unrecognized, and substitutes the estimations, appropriately modified to conform with the speaker's voice characteristics, for the unrecognized phonemes in the input sequence. In this manner, the invention reconstructs the selected sequence to account for the phonemes that were lost or degraded due to channel impairments. The end result is that the speech quality is enhanced over the case where there is no speech post-processing of the voice signals.

In a particular embodiment of the invention, a telecommunication system and method having a transmitter and receiver, for individual devices, are provided with a speech post-processor connected as the final element before conversion of the speech to aural form and delivery of the speech to a listener. The speech post-processor processes speech signals in digital form, and obtains the most likely estimation of a speech sequence that contains unrecognized phonemes. The speech post-processor has a recognizer and parser that receives speech signals, and parses them into corresponding phonemes or unrecognized phonemes. Speech sequences of preselected duration are selected, and processed through an execution trellis implemented by a Viterbi algorithm to obtain a most likely sequence estimation for sequences which contain unrecognized phonemes. Only speech sequences with unrecognized phonemes are directed to the execution trellis. Following processing, the speech sequences may be recombined in time order, or directed to D/A conversion and output to a listener via a conventional device, e.g. a speaker.

DETAILED DESCRIPTION OF A PREFERRED EMBODIMENT

Figure 1:
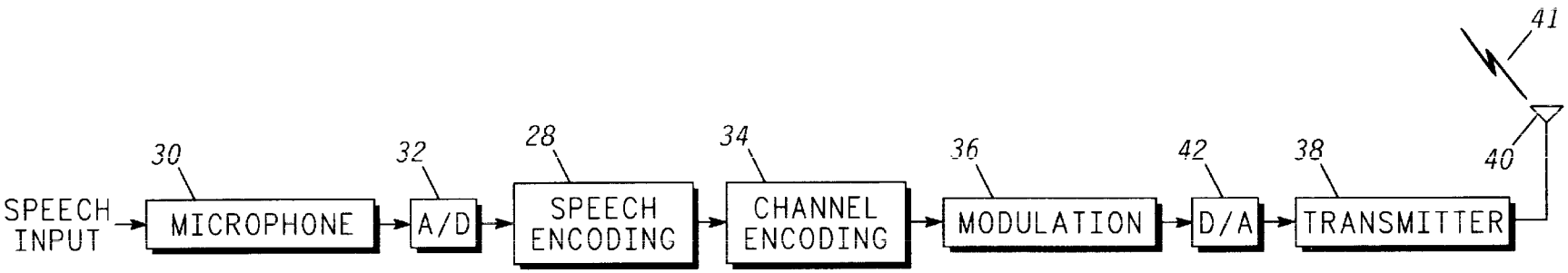
FIG. 1 is a block diagram showing the transmitter portion of the method and apparatus of the invention.
Figure 2:
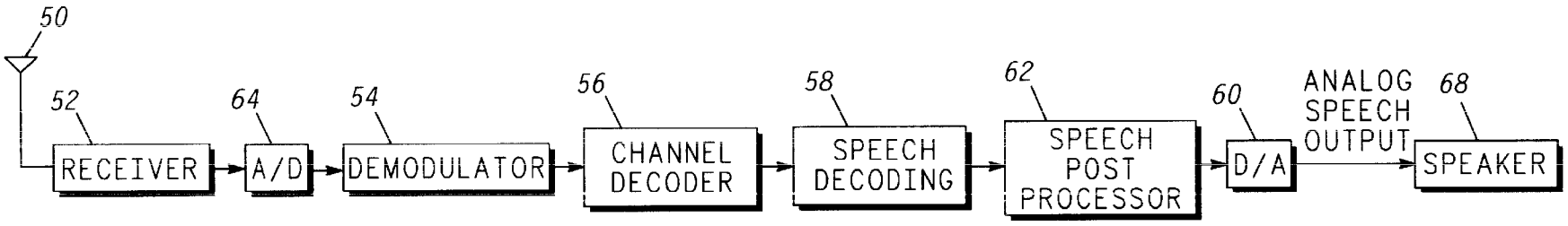
FIG. 2 is a block diagram showing the receiver portion of the method and apparatus of the invention.

In FIGS. 1 and 2, a specific embodiment of the method and apparatus of the present invention is shown in block diagrams. The novel voice communication system generally consists of a transmitter sub-system 20 and a receiver sub-system 22, which communicate via RF using antennas, if the sub-systems are in different devices. It will be appreciated that the sub-systems are usually in a single device sharing a common antenna, and in two-way communication, the transmitter of one device sends to the receiver of another device. The particular arrangement is conventional in this respect and on the transmitter side consists of a conventional voice input converter 30 (microphone), a conventional analog-to-digital converter 32, a conventional speech compression device 28, a conventional channel encoder 34 usually consisting of a forward error correcting encoder and circuits for framing and/or interleaving, a conventional modulator 36, a digital-to-analog converter 42, a conventional transmitter 38, and a conventional radiating element or antenna 40. Speech input to the voice input 30 is processed through the transmitter sub-system 20 to be transmitted via antenna 40 as an analog RF signal.

In a standard known speech communication system that is implemented digitally, the system typically works in the following way. An analog speech source is sampled at what is considered greater than or equal to the (Nyquist) rate of 8,000 samples per second for a 4 kilohertz or less band-limited speech. It is preferably converted to pulse coded modulation at 64 kilobits per second although other forms of digital voice signals could be used. That information is segmented and each segment consisting of several samples is compressed resulting in, for example, an 8 to 1 compression. The system goes from 64 kilobits per second to 8 kilobits per second sustained rate. The output of the speech compression device (a compressed voice signal) is also segmented and each segment or frame of information is encoded using forward error correcting codes such as but not limited to convolutional codes or trellis codes or whatever is selected by the designer of the system.

After that, other operations may happen such as framing or interleaving, if determined by the system designer. Next, modulation or pulse shaping of the signal takes place to allow the information to fit into the band limited channel, and of course, these operations are done digitally. Today, digital filters are frequently used for pulse shaping, etc., and that is embodied in the block 36 referenced as modulation. The modulation information is converted to analog form by a digital-to-analog converter 42 and is then up converted by an RF transmitter 38 to a transmittal signal 41 that is radiated by antenna 40.

On the receiver side, substantially the reverse or opposite sub-processes to all of the different sub-processes on the transmit side occur. The first step is to intercept the radio signal 41 via antenna 50. It is down converted to base-band via an RF receiver 52 at which point it is sampled and converted to digital information by an analog to digital converter 64. The digitized base-band information is processed by the demodulator 54 which recovers a form of information that had been fed to the modulator 36 on the transmitter. This information is transitioned to the channel decoder 56, and frame boundaries, etc. are identified to align received code words with those that were transmitted. Conventional error recovery is also performed by the channel decoder. In the next step, speech decompression of the recovered compressed voice signal is performed by the speech decoder 58, thereby generating a recovered digital voice signal. That is, the system goes from the 8 kilobit per second information to 64 kilobit per second PCM. At that point in the system, the prior art applied a form of error mitigation consisting of repeating previously decoded good frames or attenuating the bad speech information. However, according to the present invention, speech post-processing takes place in block 62, as will be explained in detail. The output from block 62 is subjected to digital-to-analog conversion in block 60, generating an analog speech output signal. The speech is produced in a form that is useful to the listener via any conventional device, such as speaker 68, that is coupled to the analog speech output signal.

Figure 3:
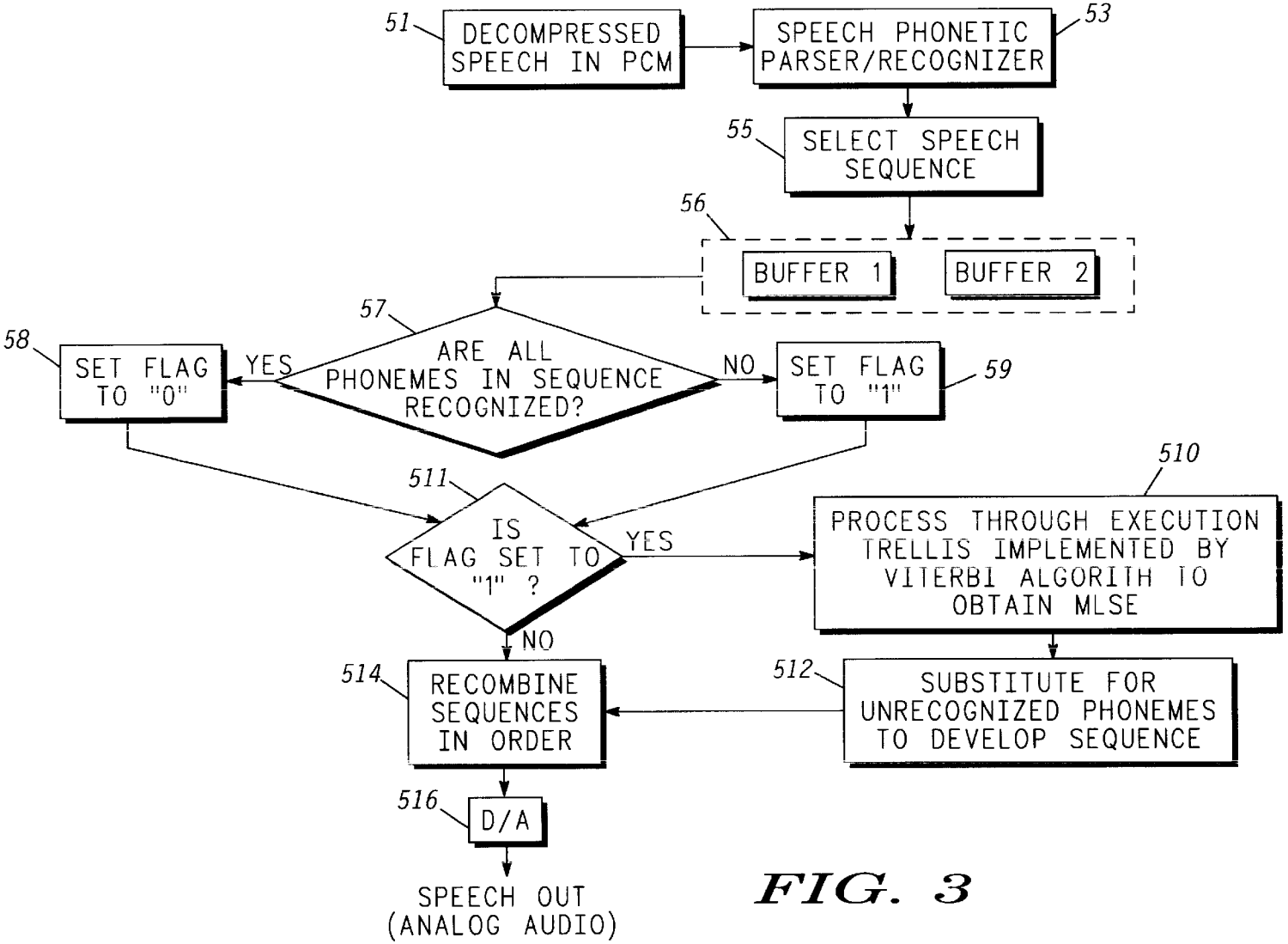
FIG. 3 is a flow chart of the speech post-processor of the method and apparatus of the invention shown in FIGS. 1 and 2.

As noted from the above, the transmitted signal 41 is intercepted by the receiver sub-system 22 through its conventional antenna 50, fed to a conventional receiver 52, and then processed serially through an analog-to-digital converter 64, a conventional demodulator 54, a conventional decoder 56, a conventional speech decoder 58 and the novel post-processor 62 of the present invention. The output of the post processor 62 goes to a conventional digital-to-analog converter 60 from which speech is output via a conventional device. All components in the receiver sub-system are conventional and known to those skilled in the art, except the inclusion and use of the novel post-processor 62 which creates a new combination. The constitution and operation of the speech post-processor 62 will be apparent to those skilled in the art from the flow chart shown in FIG. 3, and general knowledge about computing, and the programming of computers. FIG. 3 shows in the flow chart both the steps which are used to carry out the method and circuits and devices that are included as part of the apparatus of the invention.

The invention, as shown in the drawings and as will be described in more detail below, consists of replacing or adding to the standard error mitigation approach of the prior art. As previously noted, the standard techniques for error mitigation that have been used in telecommunication are usually very simple. During use of such standard error mitigation techniques, significant information is frequently lost. In contradiction to what has been taught by the prior art, the present invention uses the novel and unique speech post-processor herein disclosed which applies the Viterbi algorithm as a maximum likelihood sequence estimator on a series of received or decompressed speech phonemes that were recovered in succession, and utilizes information that is pre-computed, and therefore, stored a priori in the post-processor. This information comprises the essential inter-phonetic transitions and transitional likelihoods or a ratio or a correlation to a probability of transitioning from one phoneme to another. In any language, there can be defined a finite set of phonemes. For example, in English, there are typically a total of 42 possible phonemes defined and, of course, a pause which could be termed a 43rd phoneme. The data relating to phonemes is well known to those skilled in the art.

As will be seen from the flow chart of FIG. 3, in step S1 the speech signals are received by the speech post-processor 62 in digital PCM format, and the signals are passed directly to a conventional Speech Phonetic Parser/Recognizer where in step S3, the stream of digital signals are broken into phoneme segments. The parsing operation is done in any conventional manner, such as by use of any of the voice recognition approaches e.g., the filter bank method or use of the hidden Markov model (HMM) approach.

The phonetic parsing is accomplished by use of software that captures the sequence of PCM information, and recognizes the individual phonemes that were received in succession. What also occurs during parsing is that if a phoneme is not recognizable by parsing in block 62, Step 3, then, it is termed an erasure or a lost piece of information. What the invention does is make a choice of phoneme(s), for the particular language, based on estimates of the inter-phonetic transitional likelihoods and phonetic state transitions. The chosen phoneme(s) fill the erasure or lost piece of information. Consider, for example, the phoneme "th" from the word "the". There is a likelihood estimate that can be computed, when going from that phoneme to itself or to any of the other 41 phonemes or to a pause. In the English language, going from "th" to "e", there is a likelihood estimate in the transition between the two phonemes in the word "the". On the other hand, going from "th" directly, to say, the consonant "c" as in "ca" is quite unlikely. The probability of doing that would be extremely low. Based on this knowledge of language and the ability to compute these likelihoods based on large amounts of speech information or particular language, a trellis state diagram can be created which governs the transitions between the phonemes. Such a trellis is included in block 62, see Step 10 which will be described in detail below.

From step S3, the process proceeds to step S5, where the digital stream is divided into successive speech sequences in time order, each speech sequence being of a predetermined length or duration, preferably equivalent to from 2 to 5 seconds of speech. For reasons which will become apparent in the following explanation, the length of the selected sequences should not exceed about 5 seconds. Also, it is important for the best performance of the invention that the selected sequences of speech should not be shorter than about one second.

The out-flow of digital streams of speech sequences from step S5, is buffered, in step S6, using one or more buffers such as first-in-first-out memory. Although two are preferred, which are used alternatively, only one is required. In step S7, each individual sequence output from the buffering in Step S6 is examined in order, and a decision is made whether all phonemes are recognized in the particular individual selected sequence undergoing examination. If Yes, then in step S8, a flag is set to "0", and the sequence having all recognized phonemes is passed to step S11. If No, then in step S9, the flag is set to "1", and then, the sequence including unrecognized phonemes is passed to step S11.

In step S11, the flag is examined, and if set to "1", the sequence, containing unrecognized phonemes, is passed to step S10 where it is processed in the manner to be described. If the flag is set to "0", the sequence, containing only recognized phonemes is passed to step S14.

In step S10, the diverted speech sequences, which contain unrecognized phonemes, are processed through an execution trellis constructed to perform a state-transition process which governs inter-phonetic transitions. Processing of the sequence of phones in which an unrecognizable or missing phoneme is present is implemented by the Viterbi algorithm. This technique is known to those skilled in the art and from the descriptions set forth in the foregoing needs but little elaboration. In a known manner, from the likelihoods of transitions between phonetic segments (phonemes), known a priori, a path can be found through the trellis, using the Viterbi algorithm, that minimizes an overall distance metric between the phonemes of the received sequence including unrecognized phonemes being processed and that most likely sequence estimation of phonemes which constitutes the most probable path through the trellis. The implementation of the Viterbi algorithm to the trellis provides a maximum likelihood sequence estimation based on the pre-defined trellis which rules or governs the possible (legal) and most likely inter-phonetic transitions.

The trellis is constructed with a constraint length sufficient to capture the speech sequence undergoing examination. A recommended intervals 2 to 5 seconds worth of speech information, and not more than 5 seconds which corresponds to a maximum of 40,000 samples or approximately 320 kilobytes of data at a sample rate of 8000 samples/sec. Longer sequences would overly increase to unacceptable levels the complexity of the system and the delay in processing, whereas sequences shorter than about 1 second may not result in the optimal most likely sequence estimation.

As an example of the foregoing, the sequence of words "the quick brown fox jumped" can be parsed into segments corresponding to the phonemes in the English language. For example, "th" would be one phoneme, "e" in the word "the" would be another phoneme, followed by a pause, and then "qu" would be another phoneme, "i" is another one, "ck" as in quick would be another phoneme. The inter-phonetic transitional likelihood between "th" and "e" is known a priori, for the English language. It can be computed. The likelihood of transitioning between "e" and a pause can also be computed relative to all other transitions. The likelihood of transitioning from a pause to a "qu" as in quick can also be computed. If one labels the likelihood of transition between "th" and "e" as $p_i$, the likelihood of transition between "e" and the pause labeled as $p_j$, and the likelihood between the transition of the pause and "qu" as in quick labeled as $P_k$ then what is done is to try to align all of the phonemes in the sequence being processed with a graphical representation of a trellis that governs the inter-phonetic transitions for the language from which the sequence is classified.

As an example, the general explanation of how $p_j$ is computed is as follows. The value $p_j$ is computed from measuring the amount of times that "th" goes to all other phonemes including pauses and then measuring the number of times "th" goes to "e" as in "the" (or other words that would utilize that transition), and then divide that number by the total number of transitions from "th" to other phonemes and pauses including "e". That is a general explanation of how an inter-phonetic likelihood would be pre-computed, but as noted above, that information and computational technique is known to those skilled in the art and known a priori. That is what is stored in the computer in block 62, that is, stored in the speech post processor 62.

In the speech post-processor 62 and Step S10, the Viterbi algorithm is applied to compute a metric which applies to each state of all possible states per stage in the trellis that is in aligned with each phoneme of the sequence being processed. During the computation, the Viterbi algorithm is applied to create all these stages. What is computed as the metric update is the difference between the likelihood of transitions in the received sequence, and the likelihoods between the transitions of all the phonemes and their other transition points. For example, in the sentence, "the" as in "the quick brown fox", the metrics in stage 1 and for each state are the differences between $p_i$ and the transitional likelihoods that exist for each phonetic state in that stage added to the metric previously corresponding to each phonetic state at that stage. Upon each metric update for each phoneme at a stage, the phoneme that corresponds to the transition path that yields the smallest computed distance based on the metric update, is selected and stored as a predecessor. Therefore, for English with 42 phonemes and a pause, a set of 43 predecessors are stored per stage in an array. Also, an array of 43 metrics is stored for each stage.

This process of metric array updating and predecessor selection continues for all remaining stages corresponding to all remaining phonemes of the sequence being processed.

What happens during the processing as noted above is that whenever the attempt to recognize a phoneme that is unrecognizable occurs, then the transitional likelihood from the previous phoneme to that phoneme is given a very small value or even zero. This enables the Viterbi decoder or trellis decoder to pick a state that is most likely to have occurred. The correction is effected on a stage-by-stage basis. The Viterbi algorithm does not simple mindedly accept the most likely state for a given time instance but takes a decision based on the whole sequence. So basically, the predecessor table must be constructed, and then, at the very end of the calculations, the Viterbi algorithm arrives at the decision of the most likely sequence estimation, because it has to take into account a long sequence of information. The decision is not just performed on a stage-by-stage basis but is only made after the entire predecessor table has been constructed.

Essentially, after the entire speech sequence has been completely processed, the Viterbi algorithm seeks to find that state in the final stage of the predecessor table that has the lowest corresponding metric. From that state, the calculation back traverses on a stage by stage basis and selects a single predecessor which is a phoneme or pause.

This continues until the trace-back process exhausts all the stages in the predecessor table. This process fills in or interpolates between missing or unrecognizable phonemes into the sequence. It is well known in the art that the synthesis of phonemes can be done using LPC parameters (near predictive coding) which are known to do vocal track modeling. Also, the power level to apply to the synthesized phoneme can be obtained from the energy levels of the surrounding phonemes based on short time energies. Also, the pitch and other important parameters can be found for other phonemes by using information derived from phonemes that had been accurately received. In this manner, the pitch, duration and power of the determined segments (phonemes) are matched with the speaker's voice characteristics.

In step S12, the most likely sequence estimation (MLSE) derived from the trellis, implemented by the Viterbi algorithm, is processed in the manner described above for the determined phonemes to be inserted into the received sequence for the unrecognized phonemes, and then passed to step S14. The sequences which pass from step S7 to step S11 which contain only recognized phonemes are also passed to step S14, wherein the sequences received from both steps S11 and S12 are reordered, that is, recombined and put into the correct time order, and passed to step S16 where the digital speech signals of the recombined sequences are converted to analog signals and are passed to an analog-to-aural converter (speaker), not shown, to obtain a speech output that can be heard by a listener. Since the speech is being processed by sequences, it may be possible to pass the output sequences directly to the D/A converter.

Further elaborating the foregoing, in the construction of the execution trellis, each node, cell or state for each phoneme has a partial probability and a partial best path to it. The partial probabilities are calculated based on the most probable path to a given state (phoneme) in the sequence and the probabilities of previous or preceding states leading to the given state. The essential Markov assumption (HMM) is that the probability of a state occurring, given a preceding state sequence depends only on the preceding "n" states. Therefore, the most probable path ending at a given state in the trellis, is the most probable path to the predecessor state of a given state. This is essentially determined by the probability of the next preceding state, the inter-transitional probabilities of the given state and the actual input for the given and preceding states. Therefore, the probability of the best partial path to a given state in the trellis is the probability from the next preceding state as a function of the transitional probabilities and the input sequence. As the execution proceeds through the trellis, the maximum probability for each given state is continuously selected. Accordingly, a predecessor chart is established to remember or to point back to the best partial paths through the trellis, which optimally provoke any given state. In this way, the most likely sequence estimation of phonemes is found from all possible sequences of phonemes and finding the probability of the received or input sequence of phonemes for each possible sequence of phonemes. The most likely sequence estimation has the lowest distance metric to the input sequence. The Viterbi algorithm reduces the complexity of the calculations by using recursion and by utilizing all the possible inter-phonetic transitions between phonemes to find at each state in the trellis, the maximum partial probability for the state and the best partial path to the state.

The algorithm is initialized to calculate the inter-transitional probabilities between phonemes with the associated input sequence probabilities. A determination is made of the most probable path to the next phoneme in the sequence while remembering by a predecessor chart how to get there. This is accomplished by considering all products of transitional probabilities with the maximal probabilities already derived for the next preceding phoneme of the sequence. The largest such is remembered together with what provoked it i.e., a predecessor chart and back pointers. By determining which phoneme or state at completion of processing the input sequence, is most probable, a back-tracking through the trellis is conducted by the algorithm, following the most probable path in order to yield the sequence that is the most likely sequence estimation of the input sequence.

Use of the Viterbi algorithm to implement the trellis gives the advantage of reducing computational complexity and computational load, and looking at the entire sequence before deciding the most likely final state, and then, by using the predecessor chart, to show the most likely sequence estimation through the trellis provides good analysis of unrecognized phonemes. As noted, the algorithm proceeds through an execution trellis calculating a partial probability for each cell (phoneme), and a pointer indicating how that cell could most probably be reached. On completion, the most likely final state is taken as correct and the path to it is traced back via the predecessor chart to show the most likely sequence estimation.

For a particular input sequence having unrecognized phonemes (at least one unrecognized phoneme), the Viterbi algorithm is used to find the most likely sequence estimation. When the algorithm reaches the final state of the input sequence, the probability for the final states are the probabilities of following the optimal or most probable route to that state. Selecting the largest, and using the implied route gives the best estimation for the input sequence. The Viterbi algorithm makes a decision based on the entire sequence, and thus, can find the most likely sequence estimation for the input sequence and can recognize intermediate unrecognized phonemes by obtaining an overall sense of garbled words, or words with missing phonemes.

The Viterbi algorithm, execution trellis and inter-transitional relationships of phonemes and the aspects of computation required in step S10, are either known per se, or will be apparent to those skilled in the art from the flow chart of FIG. 3, a general knowledge of computers and the programming of computers. Implementation of the invention in a computer or processor, as taught herein will be evident to those skilled in the art.

Whereas the invention has been shown in terms of a transmitter and receiver, it will be appreciated that in any given communication system, each unit at each location will consist of a device that includes both a transmitter and a receiver using in common a single antenna, in order to have two-way communication.

Although the invention has been shown and described in terms of a specific embodiment, nevertheless, changes and modifications will be apparent to those skilled in the art which do not depart from the spirit, scope and teachings of the invention. Such are deemed to fall within the purview of the invention as claimed.

What is claimed is:

1. A telecommunication system including a wireless transmitter and wireless receiver for voice encoded signals, said wireless receiver comprising a digitally operated speech post-processor connected as an element before conversion of the speech to analog form and delivery of the speech to a listener, said speech post-processor digitally processing speech signals and obtaining a most likely estimation of at least one speech sequence containing at least one unrecognized phoneme; and wherein the speech post-processor further comprises a device for replacing the at least one unrecognized phoneme in the at least one speech sequence with at least one determined phoneme derived from the most likely estimation of the at least one speech sequence;

wherein the device of the speech post-processor includes circuitry for processing the at least one determined phoneme to adapt it to the speaker's voice characteristics.

2. A telecommunication system according to claim 1, wherein the speech post-processor comprises a recognizer and parser circuit that receives speech signals and parses into corresponding phonemes or unrecognized phonemes, and an execution trellis implemented by a Viterbi algorithm to obtain the most likely estimation of the at least one speech sequence.

3. A telecommunication system according to claim 2, further comprising a selection circuit for directing only sequences with at least one unrecognized phoneme to the execution trellis, and a circuit to combine the speech sequences with all recognized phonemes in time order with the sequences processed through the trellis.

4. A device for effecting telecommunications comprising a wireless receiver, said wireless receiver including a digitally operated speech post-processor connected as an element before conversion of the speech to analog form and delivery of the speech to a listener, said speech post-processor digitally processing speech signals and obtaining a most likely estimation of at least one speech sequence containing at least one unrecognized phoneme; and wherein the speech post-processor further comprises a device for replacing the at least one unrecognized phoneme in the at least one speech sequence with a determined phoneme derived from the most likely estimation of the at least one speech sequence;

wherein said device of the speech post-processor includes circuitry for processing the at least one determined phoneme to adapt it to the speaker's voice characteristics.

5. A device for effecting telecommunications according to claim 4, wherein the speech post-processor comprises a recognizer and parser circuit that receives speech signals and parses into corresponding phonemes or unrecognized phonemes, and an execution trellis implemented by a Viterbi algorithm to obtain the most likely estimation for the at least one speech sequence.

6. A device for effecting telecommunications according to claim 4, further comprising a selection circuit for directing only sequences with at least one unrecognized phoneme to the execution trellis, and a circuit to combine the speech sequences with all recognized phonemes in time order with the sequences processed through the trellis.

* * * * *